US007810568B2

(12) United States Patent
Toulouse

(10) Patent No.: US 7,810,568 B2
(45) Date of Patent: Oct. 12, 2010

(54) METHOD OF MAKING A WINDOW IN A TUBULAR USING AN EXPANDABLE WATERMELON MILL

(75) Inventor: Jeffrey E. Toulouse, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 111 days.

(21) Appl. No.: 11/583,475

(22) Filed: Oct. 19, 2006

(65) Prior Publication Data

US 2008/0093075 A1 Apr. 24, 2008

(51) Int. Cl.
*E21B 29/06* (2006.01)
*E21B 7/04* (2006.01)

(52) U.S. Cl. ..... 166/298; 175/61; 175/384; 175/286; 166/55.1; 166/55.7

(58) Field of Classification Search ..... 175/276, 175/61, 384, 255.3, 286, 80, 385, 406; 166/298, 166/55.7, 55.1, 255.3
See application file for complete search history.

(56) References Cited

U.S. PATENT DOCUMENTS

| | | | | |
|---|---|---|---|---|
| 48,026 | A * | 5/1865 | Oliver | 175/286 |
| 54,454 | A * | 5/1866 | Webb | 175/286 |
| 124,932 | A * | 3/1872 | Chester | 175/286 |
| 1,796,546 | A * | 3/1931 | Campbell et al. | 175/286 |
| 2,586,878 | A * | 2/1952 | Staton | 175/83 |
| 2,991,834 | A * | 7/1961 | Kennard | 166/55.7 |
| 5,109,924 | A | 5/1992 | Jurgens et al. | |
| 6,155,343 | A | 12/2000 | Nazzal et al. | |
| 6,880,650 | B2 | 4/2005 | Hoffmaster et al. | |
| 6,920,944 | B2 | 7/2005 | Eppink et al. | |
| 7,036,611 | B2 | 5/2006 | Radford et al. | |
| 7,048,078 | B2 | 5/2006 | Dewey et al. | |
| 7,308,937 | B2 | 12/2007 | Radford et al. | |
| 2004/0099444 | A1 * | 5/2004 | Chen et al. | 175/61 |
| 2004/0149430 | A1 * | 8/2004 | Campbell et al. | 166/216 |
| 2007/0007000 | A1 * | 1/2007 | Dewey et al. | 166/55.7 |

OTHER PUBLICATIONS

Waddell, Kevin, et al., "Installation of Solid Expandable Tubular Systems Through Milled Casing Windows", IADC/SPE 87208, Mar. 2004, 1-10.

Nazzal, Greg, et al., "Development, Testing and Field History of a True One Trip Casing Exit System", SPE 35662, May 1996, 1-10.

(Continued)

*Primary Examiner*—William P Neuder
*Assistant Examiner*—Cathleen R Hutchins
(74) *Attorney, Agent, or Firm*—Steve Rosenblatt

(57) ABSTRACT

A watermelon mill has a smaller dimension for run in and a larger one for reaming out the window made by a window mill and passes through a smaller drift and then gets larger for more effective widening of the window. The cutters are preferably tungsten carbide or polycrystalline diamond inserts and they are mounted to blades that are ramped outwardly by a cone upon relative movement between the two. The body can be in multiple pieces that are rotationally locked and movable relative to each other longitudinally. Actuation to the larger dimension can be by setting down weight or by fluid pressure with the dimension getting smaller as a return spring allows the cutters to retract upon removal of applied pressure.

11 Claims, 2 Drawing Sheets

OTHER PUBLICATIONS

Wright, H.J., "Coiled-Tubing Drilling Reentry: Case History from East Kalimantan", SPE 89632, Mar. 2004, 1-7.

Toulouse, J.E., "Improved Window Cutting Efficiency Cuts Casing Exits Costs", SPE 101835, Sep. 2006, 1-4.

* cited by examiner

METHOD OF MAKING A WINDOW IN A TUBULAR USING AN EXPANDABLE WATERMELON MILL

FIELD OF THE INVENTION

The field of this invention is window milling in casing and more particularly using a watermelon mill behind a window mill that can be enlarged after it is run in to the window so as to widen the window more.

BACKGROUND OF THE INVENTION

Lateral bores are frequently needed to improve or continue production from a wellbore. When the drilling of a lateral becomes necessary, a diverter tool with a long ramp known as a whipstock is run in and oriented and anchored. Usually, to save rig time, an assembly of mills is run in with the whipstock. The anchor for the whipstock can be run in separately or together with the whipstock. The whipstock ramp is at a very gradual angle to slowly guide a window mill into the casing wall to make an opening known as a window. Generally, the initial mill is secured for run in to the top of the whipstock ramp at a lug. Initiating window mill rotation breaks the lug connection and allows the window mill to descend. As the window mill descends it is guided by the ramp that is sloped at about 3 degrees slowly into the casing wall. As a result, the initial window shape is somewhat elliptical. It starts fairly narrow and gets as wide as the window mill. The window gradually narrows as the mill moves its centerline past the casing wall while continuing to descend to the bottom representing a complete exit of the window mill through the casing wall.

For a variety of reasons the width or diameter of the window made by the window mill is not the desired final window diameter required to support the exit of other tools to drill and complete the lateral (e.g. a window must be able to pass or 'drift' a tool with an outside diameter larger than normal). Typically, the window mill is run in tandem with other mills disposed uphole from it. These generally elliptically shaped mills have come to be known as watermelon mills because of their appearance. Typically the watermelon mill(s) get the same size as the window mill or get progressively larger in the order that they enter the initial window so that the window can be made wider in stages. This type of system done in a single trip is shown in U.S. Pat. No. 5,109,924.

When sizing the watermelon mills attention has to be paid to the spacing of the mills, the degree of flexibility of the connecting pieces and the inside clearance of the tubulars through which the watermelon mills must pass, to name a few considerations. Many times the inside clearance diameter in the tubular, known as the drift diameter is the limiting factor on the maximum dimension of the watermelon mill. Clearly, if the watermelon mills can be made bigger and still reach the window, they would be in a better position to enlarge the window to at least the minimum needed width for drilling and completing the lateral through the window. A specific application would be the installation of an expandable liner through the window then allowing a constant 'drift' through the original wellbore casing as well as the new lateral liner.

In drilling applications, under-reamers have been used that have blades that retract and then get pivoted by one end to go to a bigger size for increasing the bore size. The opposite end from the pivot end is cantilevered. Other designs for a technique called reaming while drilling (RWD) use reaming blades that are telescoped radially to make a bigger hole than the bit that is adjacently mounted. Some recent under reaming tools are illustrated in U.S. Pat. Nos. 7,048,078; 6,920,944 and 6,880,650.

The present invention addresses this concern by providing a watermelon mill that can pass a given drift diameter in the tubular and then have its outside dimension increased shortly before or during the time it reams the window made by the window mill wider. With the ability to increase the milling diameter, a window with a larger drift than the original wellbore casing can be milled. Also, the number of mills in a bottom hole assembly can be reduced and that makes it easier to run the assembly in a well particularly if it is highly deviated. The diameter of the mill can be changed even as it reams the window. These and other features of the present invention will be more readily understood by those skilled in the art from a review of the detailed description of the preferred embodiment and the associated drawings while the claims define the full scope of the invention.

SUMMARY OF THE INVENTION

A watermelon mill has a smaller dimension for run in and a larger one for reaming out the window made by a window mill and passes through a smaller drift and then gets larger for more effective widening of the window. The cutters are preferably tungsten carbide or polycrystalline diamond inserts and they are mounted to blades that are ramped outwardly by a cone upon relative movement between the two. The body can be in multiple pieces that are rotationally locked and movable relative to each other longitudinally. Actuation to the larger dimension can be by setting down weight or by fluid pressure with the dimension getting smaller as a return spring allows the cutters to retract upon removal of applied pressure.

DETAILED DESCRIPTION OF THE DRAWINGS

DETAILED DESCRIPTION OF THE PREFERRED EMBODIMENT

Figure 1:
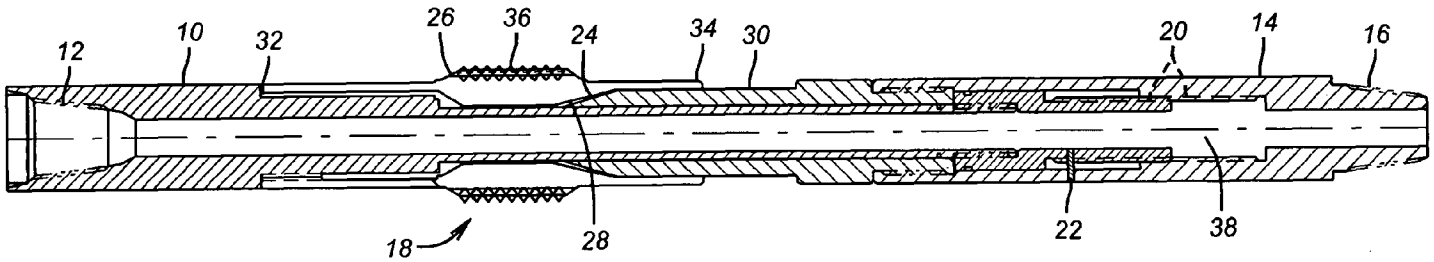
FIG. 1 is a section view of a set down weight version of the mill of the present invention shown in the run in position.
Figure 4:
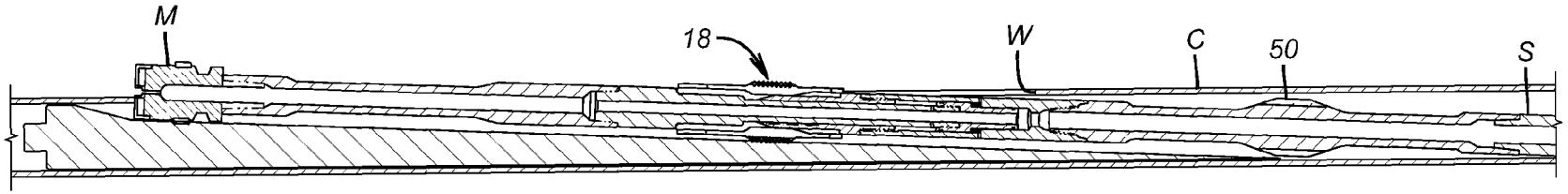
FIG. 4 is an assembly view of a multi-mill system including the mill of FIGS. 1-3 making a window in a tubular.

FIGS. 1 and 4 show a top sub 10 that has a string connected at thread 12. A bottom sub 14 supports at thread 16 a window mill. The surrounding casing is milled to make a window and the whipstock and its anchor that guide the illustrated mills are not shown as these are items well known in the art. While a single watermelon mill 18 of the present invention is shown in FIG. 1, those skilled in the art will appreciate that, if desired, more than one such mill can be mounted in series for sequential widening of a window made by a window mill. FIG. 4 illustrates a window mill that is through the window followed by the mill 18 and then another watermelon mill 50 following mill 18. In the preferred embodiment, the variability of the watermelon mill 18 allows for sufficient widening of a window so as to shorten the bottom hole assembly by just using one watermelon mill 18. For example, mill 18 has a run in hole drift of 4.125 inches and get enlarge to about 5.00 inches when enlarging a window.

The way it changes dimensions in the FIG. 1 embodiment is by setting down weight on top sub 10. Top sub 10 is connected to bottom sub 14 by splines 20 that prevent relative rotation so that applied torque on top sub 10 is transferred to bottom sub 14 and to the window mill (not shown). When weight is set down on top sub 10 a shear pin 22 breaks and top sub 10 moves down with respect to bottom sub 14. Ramp surface 24 is connected to the stationary bottom sub 14 while blades 26 with lower ramp surface 28 ride up ramp surface 24 and wind up on support surface 30. Top 32 and bottom 34 of each blade is retained by the top sub 10 against relative rotation so that turning of the top sub 10 with blades 26 extended results in inserts 36 which are preferably tungsten carbide or polycrystalline diamond or a combination of both attacks the window to ream it out to the larger dimension of the mill 18 as the assembly advances downhole.

Figure 2:
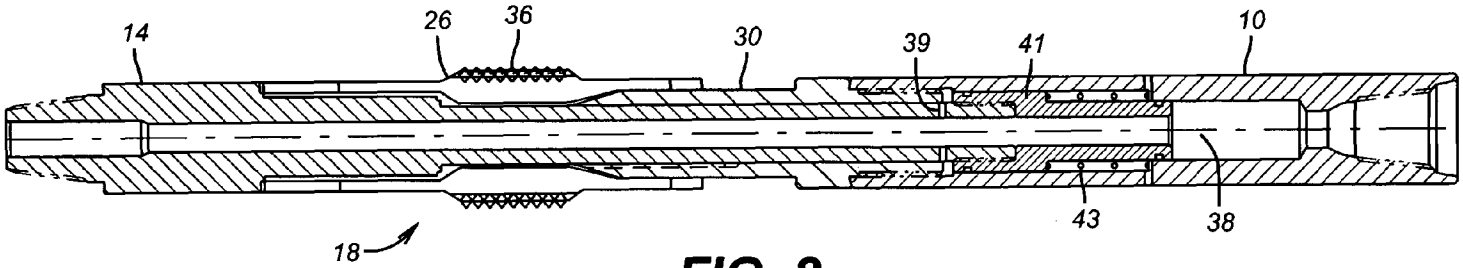
FIG. 2 is a pressure actuated embodiment of the design of FIG. 1.
Figure 3:
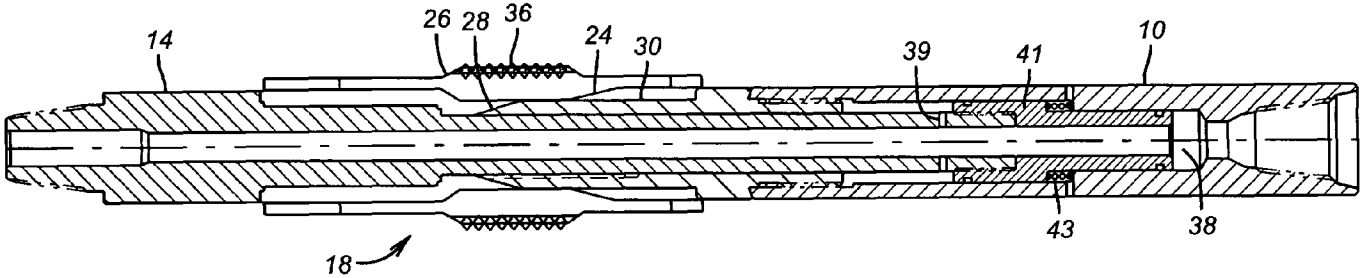
FIG. 3 is the view of FIG. 2 with the mill in the extended position.

As an alternative, shown in FIG. 2, to using set down weight, the same result can be obtained using pressure supplied to a piston through passage 38 by simply increasing flow rate to build back pressure through port 39 to the piston 41 to drive the subs 10 and 14 together, see FIG. 3, to force the blades 26 onto surface 30 against the force of a return spring 43 such that releasing the pressure will allow the return spring 43 to extend the tool and retract the blades 26. Simply pulling up without applied pressure in passage 38 will also extend the tool and get the same result so that the assembly can be pulled from the well as the mill 18 goes to its small dimension.

Optionally, the initial or window mill can be configured in this manner to vary the milling diameter as the window is initially formed by employing the structure described above for the subsequent or watermelon mill. Those skilled in the art will appreciate that mills of various external shapes can be used for the initial window and for subsequently widening it and that reference to a window mill is but one style of mill that can be made variable in dimension for window initial milling or widening. A watermelon mill just happens to be a shape of a mill frequently used for the purpose of widening a window but other mill types are within the scope of the invention. Using more that one mill with capabilities to change dimension including the initial window mill is also within the scope of the invention. The window need not be started by a mill. It can be created explosively or with chemicals or by other techniques.

The above description is illustrative of the preferred embodiment and many modifications may be made by those skilled in the art without departing from the invention whose scope is to be determined from the literal and equivalent scope of the claims below.

I claim:

1. A method of making a window in a tubular, comprising:
creating a window through an existing downhole tubular;
running in and rotating an articulated mill on a string having a body having a longitudinal axis and supporting a cutter assembly comprising cutting components, all of said cutting components extending an initial distance with respect to said body in the direction of said longitudinal axis and all of which articulate in tandem while maintaining their relative positions with respect to said longitudinal axis by moving substantially parallel to a stationary ramp on said body which results in radial extension of said cutting components away from said body from an initial dimension through the tubular and increasing the dimension of the mill by articulating said cutting components at a location at least in part within the tubular by axially moving one part of said mill with respect to another part of said body to change the support for said components from one part of said body to another; and initiating said window with a window mill ahead of said articulated mill.

2. The method of claim 1, comprising:
enlarging the window diameter to said increased dimension.

3. The method of claim 2, comprising:
increasing said dimension by setting down weight on said string.

4. The method of claim 2, comprising:
increasing said dimension by applying internal pressure in said mill.

5. The method of claim 4, comprising:
driving said cutting components radially outwardly with relative body movement.

6. The method of claim 5, comprising:
using a wedge to drive said cutting components radially.

7. The method of claim 6, comprising:
using a piston to drive said cutting components and said wedge together.

8. The method of claim 7, comprising:
driving said piston against a biasing force when moving said cutting components radially outwardly.

9. The method of claim 1, comprising:
running in a watermelon mill behind said window mill.

10. The method of claim 9, comprising:
using only one watermelon mill to finish the window.

11. The method of claim 8, comprising:
retracting said cutting components radially by removing applied pressure to let a spring push said cutting components off said wedge.

* * * * *